US005868858A

United States Patent [19]

Creed

[11] Patent Number: 5,868,858

[45] Date of Patent: Feb. 9, 1999

[54] METHOD AND APPARATUS FOR CLEANING HEATING AIR CONDITIONING AND VENTILATING DUCTS

[76] Inventor: Bruce W. Creed, 4379 S. Dye Rd., Swartz Creek, Mich. 48473

[21] Appl. No.: 964,905

[22] Filed: Nov. 5, 1997

[51] Int. Cl.[6] ..... B08B 9/04; B08B 3/02

[52] U.S. Cl. ..... 134/8; 134/21; 134/22.12; 134/24; 15/345; 15/395

[58] Field of Search ..... 134/8, 22.12, 22.11, 134/21, 23, 24; 15/104.061, 345, 395

[56] References Cited

U.S. PATENT DOCUMENTS

| | | | |
|---|---|---|---|
| 526,141 | 9/1894 | Bloomer . | |
| 2,508,659 | 5/1950 | Brown | 15/104 |
| 2,794,197 | 6/1957 | Crane | 15/104 |
| 3,091,433 | 5/1963 | Riley, Jr. | 254/134 |
| 3,485,671 | 12/1969 | Stephens | 134/8 |
| 4,011,100 | 3/1977 | Ross | 134/104 |
| 4,141,753 | 2/1979 | Creed | 134/134 |
| 4,792,363 | 12/1988 | Franklin, Jr. | 134/15 |
| 4,800,616 | 1/1989 | Wade | 15/395 |
| 4,984,329 | 1/1991 | Wade | 15/395 |
| 5,003,998 | 4/1991 | Collett | 134/134 |
| 5,364,473 | 11/1994 | Van Der Does | 134/134 |
| 5,438,729 | 8/1995 | Powell | 15/345 |
| 5,472,514 | 12/1995 | Grimsley | 15/395 |
| 5,551,458 | 9/1996 | Faxon | 134/22.12 |
| 5,580,393 | 12/1996 | Lawther | 134/134 |
| 5,584,093 | 12/1996 | Melendres | 15/395 |

*Primary Examiner*—Jill Warden
*Assistant Examiner*—Saeed Chaudhry
*Attorney, Agent, or Firm*—John J. Swartz

[57] ABSTRACT

Method and apparatus for cleaning a heating, ventilating and air conditioning duct comprising a high pressure air emitting nozzle which is disposable inside the duct and an expansible and contractible draught member, which is responsive to differential pressure being created on opposite sides thereof, for drawing the high pressure air emitting member in a downstream path of travel through the duct. The draught member includes a sheet of fabric which is coupled, at its perimetrical edge portion via a plurality of lines, to the high pressure air emitting nozzle. The perimetrical edge of the fabric sheet, in its expanded condition, is spaced from a confronting portion of the duct via a low pressure, high velocity air zone which causes the draught member to move in a to-and-fro transverse path as it is moved downstream. A strip of abrasive material is provided along the perimeter of the draught member for wiping the inside of the duct as it moves to-and-fro downstream. The dislodged dirt is entrained in the high velocity air stream and is moved downstream.

39 Claims, 3 Drawing Sheets

METHOD AND APPARATUS FOR CLEANING HEATING AIR CONDITIONING AND VENTILATING DUCTS

BACKGROUND OF THE INVENTION

1. Field of the Invention

This invention relates to method and apparatus for cleaning a hollow air duct and more particularly, to new and novel method and apparatus for drawing an air emitting cleaning nozzle and a high pressure air supply hose coupled thereto through a heating, ventilating and air conditioning duct.

2. Description of the Prior Art and Objects

Commercial and industrial buildings typically include heating, ventilating and air conditioning ducts, commonly referred to as HVAC ducts. Some of these ducts are extremely large. Heretofore, one prior art method of cleaning the ducts included having someone walk inside the duct and manually scrape or dislodge the material. Such manually dislodged dirt would be picked up with a vacuum sweeper or a broom and a dust pan. Such activity is now prohibited by the occupational safety laws which will not allow anyone to walk in a confined area without a portable sniffer to check the air. Accordingly, it is an object of the present invention to provide a new and novel method and apparatus for cleaning a HVAC duct which will be more efficient and less expensive than the prior art method and apparatus.

Apparatus has been provided heretofore for cleaning heating, ventilating and air conditioning ducts, sometimes referred to as HVAC ducts, such as that disclosed in U.S. Pat. No. 5,003,998 issued to Donald H. Collett on Apr. 2, 1991. The aforementioned Collett patent discloses a so-called skip ball which is mounted on the end of a highly pressurized air supply hose that is disposed in the air duct to be cleaned via a hole cut in the side wall of the air duct. The air being emitted by the skip ball is, in some instances, as disclosed in the Collett patent, emitted at an inclined angle relative to the axis of the hose and the path of travel of the skip ball and the hose. The hose is pushed downstream to move the skip ball downstream. In the Collett patent, forwardly outwardly diverging air outlet passages are provided in the skip ball for directing high velocity cleaning air at an angle relative to the duct side wall. The air being emitted tends to retard the forward downstream progress of the skip ball in the duct.

Another prior art skip ball utilizes air emitting passages which are reversely angularly disposed to aid the propulsion of the skip ball through the duct. Due to the weight of the prior art ball and hose, the ball which, with the exception of the air supply hose, is unsupported, will sometimes engage the bottom wall of the duct and catch on any inwardly extending projections, such as fasteners, that frequently appear on the inside of an HVAC duct. This prior art system has further limitations because the cleaning air being outwardly emitted in the direction of the travel of the hose will tend to cause the ball to move sideways and catch on obstructions and extending inwardly into the duct. Such prior art systems and techniques are effective in only moving the skip ball through a limited distance such, as for example, 20–30 feet. Due to the extreme length of such HVAC ducts, the manual feeding of the high pressure air hose through the duct is ineffective. Thereafter, apertures must be cut at regular intervals in the duct and the nozzle and hose retracted from an upstream aperture and reinserted through successive downstream apertures and the operation repeated.

Accordingly, it is an object of the present invention to provide new and novel method and apparatus for cleaning HVAC ducts which will draw a high velocity air emitting nozzle downstream through a substantially greater distance than that of the prior art systems.

It is another object of the present invention to provide method and apparatus of the type described for supporting a high velocity air cleaning nozzle in spaced relation with the interior wall of the duct and concurrently moving the nozzle downstream.

Although the skip balls, such as that in the aforementioned U.S. Pat. No. 5,003,998, are able, under limited circumstances,to dislodge some of the dirt material through a limited portion of the duct, there will be insufficient vacuum forces to move the dislodged dirt particles. Accordingly, it is another object of the present invention to provide new and novel method and apparatus for cleaning HVAC ducts which will draw away the dislodged material with higher velocity streams of air in the duct than otherwise exists within the duct.

It is another object of the present invention to provide method and apparatus for cleaning heating, ventilating and air conditioning ducts which includes new and novel apparatus for drawing a high pressure air emitting member through the duct.

Typically, heating, ventilating and air conditioning systems include an air moving fan or blower which forces air through ducts in a direction away from the fan and simultaneously creates a vacuum to draw return air through a return duct to thus, circulate air throughout a building. It has been found that additional vacuum forces can be temporarily imposed in the duct by coupling a vacuum creating unit to a downstream portion of an air supply duct coupled to a portable fan.

The apparatus constructed according to the present invention contemplates a "parachute" or "umbrella" type draught member which is disposed in the HVAC duct to be drawn by the vacuum forces in a downstream path of travel. The draught member comprises an expansible and contractible sheet of fabric which is coupled to high pressure, air emitting nozzle via a plurality of coupling lines which are coupled to perimetrically spaced portions of the sheet of fabric. Accordingly, it is another object of the present invention to provide method and apparatus for cleaning air ducts of the type described including a draught member which is disposed in the duct and is coupled to the air emitting member for drawing the air emitting member downstream.

It has been found, according to the present invention, that if the "parachute" is smaller than the duct, the parachute becomes unstable and laterally whips back and forth as it is moved downstream. This is occasioned because the heating, ventilating and air conditioning air passing through the duct must now pass through a reduced cross sectional area in the gap between the edge of the parachute and the adjacent confronting portion of the duct being cleaned. This, in essence, creates a venturi effect which draws the heating, ventilating and air conditioning air to pass through the restricted passage at a substantially high velocity to more effectively draw the dislodged particles downstream. Accordingly, it is another object of the present invention to provide method and apparatus of the type described which will block a portion, but not all, of an HVAC duct to create a high velocity air stream in a portion of the HVAC duct to funnel the air passing through the duct through a reduced cross sectional area and thereby increase the velocity of air passing therethrough and more effectively aid the movement of the dislodged dirt downstream.

Applicant's prior U.S. Pat. No. 4,141,753 issued on Feb. 27, 1979 to Bruce W. Creed, the inventor herein, discloses method and apparatus for the in-situ internal cleaning of a hollow suction duct which pulls a liquid emitting member through the duct. Although Applicant's prior art patent discloses the use of a parachute type device, this prior art parachute was not disposed in the duct with the liquid emitting member and did not directly draw the liquid emitting member through the duct but rather was utilized to draw a light weight wire through the duct which, in turn, was coupled to a heavier cable which, in turn, was coupled to the relatively heavy liquid emitting nozzle. Accordingly, it is another object of the present invention to provide new and novel method and apparatus of the type described for cleaning air ducts with high pressure air.

In Applicant's prior art patented system, the parachute substantially closed the entire duct. Accordingly, it is another object of the present invention to provide method and apparatus of the type described which includes an expansible and contractible draught member which will close a substantial portion, but not all of the duct, to create a low pressure, high velocity zone between a perimetrical portion of the expansible and contractible member and the adjacent confronting portion of the duct to pass the heating, ventilating and air conditioning air therethrough with a higher velocity than velocity of the air otherwise passing through the duct.

It is another object of the present invention to provide method and apparatus of the type described for cleaning a HVAC duct and which will alternately form low pressure zones between perimetrically spaced portions of the expansible and contractible member and adjacent confronting portions of the duct to cause the expansible and contractible member to move in a to-and-fro transverse path as it is moved downstream.

The present invention also contemplates the use of an abrasive member along the perimetrical edge of the sheet of fabric which will wipe a portion of the duct as it is moved to-and-fro and as it moves downstream. Accordingly, it is another object of the present invention to provide a band of abrasive material along the outer perimetrical edge of an expansible and contractible draught member for drawing a high pressure, air emitting nozzle downstream.

The air being emitted by the nozzle in the aforementioned U.S. Pat. No. 5,003,998 impinges on the wall with a glancing blow. Such a blow will not have maximum impact on the dirt to be dislodged. Accordingly, it is another object of the present invention to provide method and apparatus for cleaning heating, air conditioning and ventilating ducts which includes an air nozzle which will emit pressurized air in a stream perpendicular, or normal, to the air duct and perpendicular to the axis of the duct.

It is another object of the present invention to provide a method and apparatus for cleaning hollow HVAC ducts which will more effectively remove particles of dirt that inadvertently accumulates on the inside of the duct.

It is a further object of the present invention to provide method and apparatus of the type described which includes an expansible and contractible member that will, in expanded condition, close a majority of the duct to increase the velocity of the air in a gap which is disposed between the perimetrical edge of the expansible contractible member on the confronting portion of the duct to draw debris downstream therewith to clean the duct.

Various other vent and duct cleaning systems are disclosed in the following cited prior art patents which are of interest but do not disclose Applicant's construction:

| U.S. Pat. No. : | PATENTEE | DATE OF ISSUE |
|---|---|---|
| 5,580,393 | Lawther | December 3, 1996 |
| 5,364,473 | Van Der Does | November 15, 1994 |
| 5,003,998 | Collett | April 2, 1991 |
| 4,792,363 | Franklin, Jr. et al | December 20, 1988 |
| 4,011,100 | Ross | March 8, 1977 |
| 3,091,433 | Riley, et al | May 28, 1963 |
| 2,794,197 | Crane | June 4, 1957 |
| 2,508,659 | Brown | May 23, 1950 |

Other objects and advantages of the present invention will become apparent to those of ordinary skill in the art as the description thereof proceeds.

SUMMARY OF THE INVENTION

Method and apparatus for the in-situ cleaning the inside surface of a hollow air duct having a passage therein through which a stream of air, under pressure, passes in a downstream path of travel, said apparatus comprising: a high pressure air emitting member, coupled to a source of high pressure air, for emitting high pressure air in a direction toward the inside surface of the duct, mechanism for moving the air emitting member in a downstream path of travel including a foldable sheet of fabric responsive to differential pressure created on opposite sides thereof for expanding between a contracted condition and an expanded condition in the duct, the fabric member having a central sheet portion and a perimetrical portion surrounding a central sheet portion, and a plurality of cords coupled between the perimetrical sheet portion and the high pressure air emitting member for drawing the air emitting member downstream.

DESCRIPTION OF THE DRAWINGS

The invention may be more readily understood by referring to the accompanying drawings, in which.

DESCRIPTION OF PREFERRED EMBODIMENT

Figure 1:
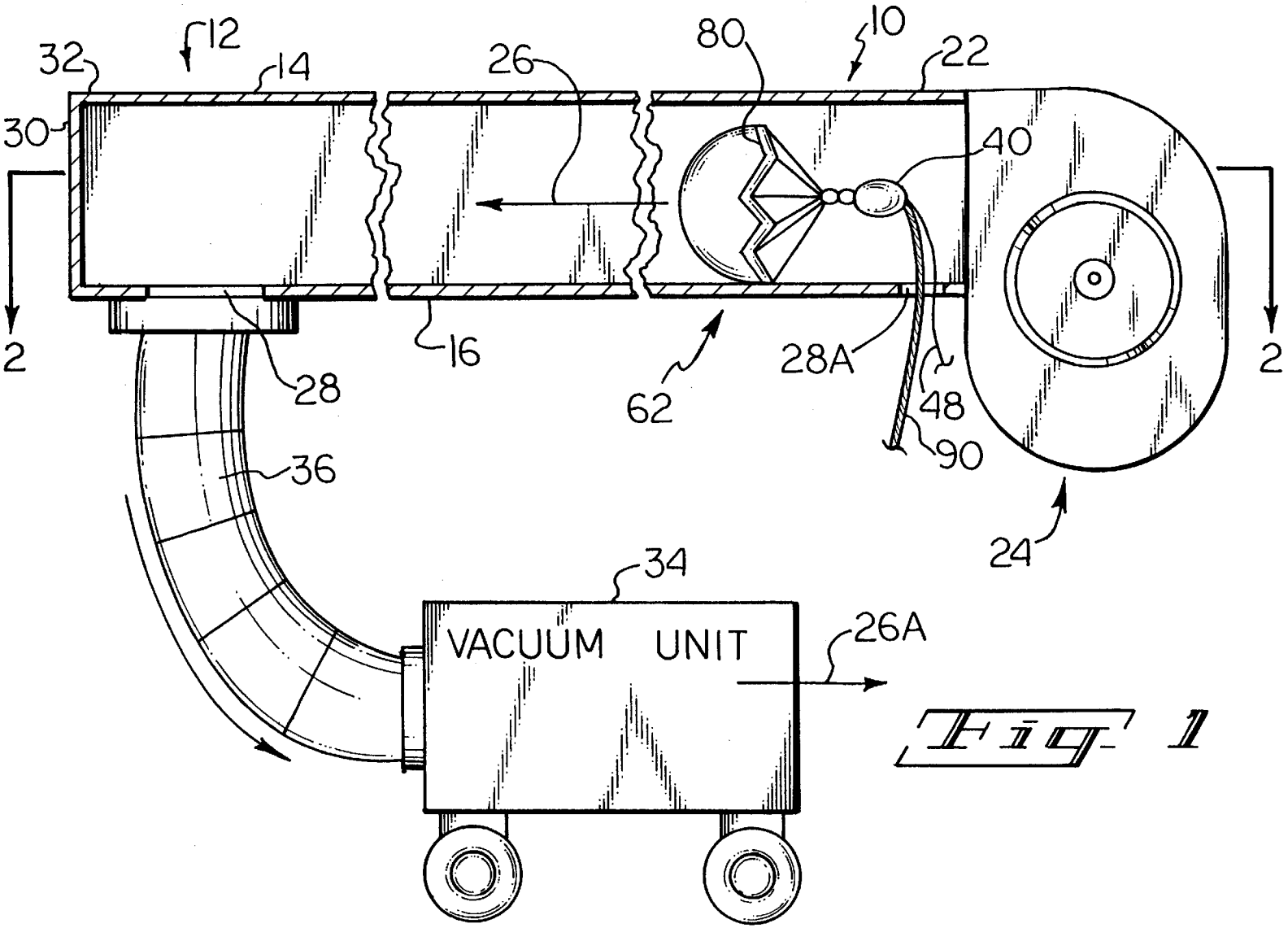
FIG. 1 is a sectional side view of apparatus constructed according to the present invention being disposed in a heating, ventilating and air conditioning duct to be cleaned.
Figure 2:
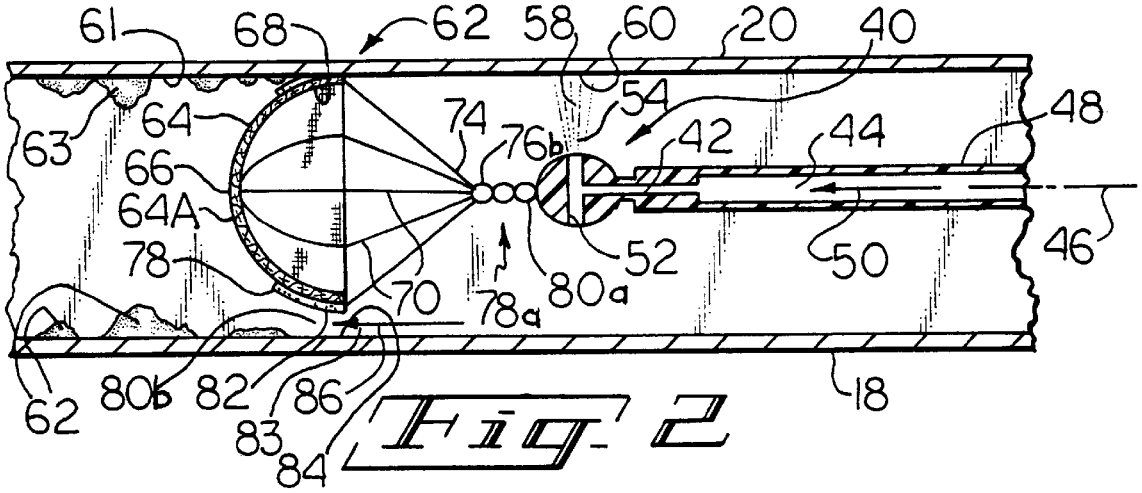
FIG. 2 is a sectional plan view, taken along the line 2—2 of FIG. 1; illustrating the apparatus constructed according to the present invention disposed, in one position, within a HVAC duct to be cleaned.

Apparatus, generally designated 10, constructed according to the present invention, is particularly adapted for use in cleaning a heating, ventilating and air conditioning duct (hereinafter sometimes referred to HVAC duct), generally designated 12, having top and bottom walls 14 and 16, respectively, spanned by front and rear side walls 18 and 20, respectively (FIG. 2). The upstream end 22 of the duct 12 coupled to a fan or blower unit, generally designated 24, for blowing heating, ventilating or air conditioning air downstream, in the direction of the arrow 26, toward the downstream end 32 of the duct 12 is closed by an end wall 30.

A vent hole 28 is cut into the bottom wall 16 adjacent the downstream end 32 of the duct 12. The downstream vent hole 28 is coupled to an auxiliary vacuum creating source 34 via a hose 36 for creating additional vacuum forces tending to move air, in the duct 12 downstream in the direction of the arrow 26. The vacuum unit 34 may suitably move ail at the rate of 1,750 cubic feet per minute.

The apparatus 10 constructed according to the present invention includes a high pressure air nozzle or so-called "skip ball", generally designated 40, having an inlet passage 42 provided with an axis 44 which is axially aligned with the longitudinal axis 46 of a high pressure air hose 48 that is coupled at its upstream end (not shown) to a high pressure air source, such as a high pressure pump, for moving high pressure air downstream in the direction of the arrow 50. The hose 48, which may suitably comprise reinforced plastic or neoprene material, and nozzle 40 are inserted into the duct 12 through an opening 28A cut into the upstream end 22 of the duct 12.

The nozzle 40 includes a plurality of spaced apart discharge outlet or passages 52 each having an axis 54 which is normal or perpendicular to the axis 44 and also normal or perpendicular to the walls 14, 16, 18 and 20. Air being emitted air in an air stream, schematically represented at 58, will impinge upon the inside wall surface 60 to dislodge dirt particles 63 or the like which inadvertently accumulate on the inside duct wall.

Inflatable and deflatable mechanism, generally designated 62, is provided for drawing the nozzle 40 and hose 48 downstream and includes a sheet 64 of fabric, such as nylon, which is expansible and collapsible between the collapsed position, illustrated in chain lines in FIG. 2, and an expanded condition, illustrated in solid lines in FIG. 2, via the differential pressure created by the vacuum unit 34 as well as the air being blown by the unit 24 on downstream and upstream sides, 64A and 64B respectively, of the sheet 64. The sheet of fabric 64 includes a central portion 66 and a perimetrically extending terminal edge portion 68 which is coupled to the skip ball 40 via a plurality of perimetrically spaced apart lines 70 each having one end 72 coupled to the perimetrical terminal edge portion 68 and an opposite end 74 coupled to one end 76*b* of a swivel, generally designated 78*a*, having an opposite end 80*a* coupled to the nozzle 40 which may comprise plastic or aluminum material.

Disposed about the outer peripheral surface 76*a* of the perimetrical portion 68 is a strip or layer 78 of abrasive material which has an outer portion 80 which can abrade the inside surfaces of walls 14, 16, 18 and 20 and remove the particles of dirt 63 adhering thereto. The strip 78 of material may suitably comprise material sold under the trademark "Velcro".

If desired, a cable 90 may be coupled to the skip ball 40 to control the downstream movement of the parachute member 62. Particularly with large parachutes, forces tending to move the parachute downstream would be extremely large and the hose 48 may have insufficient strength to restrain downstream movement of the parachute 62.

PRIOR ART

Figure 6:
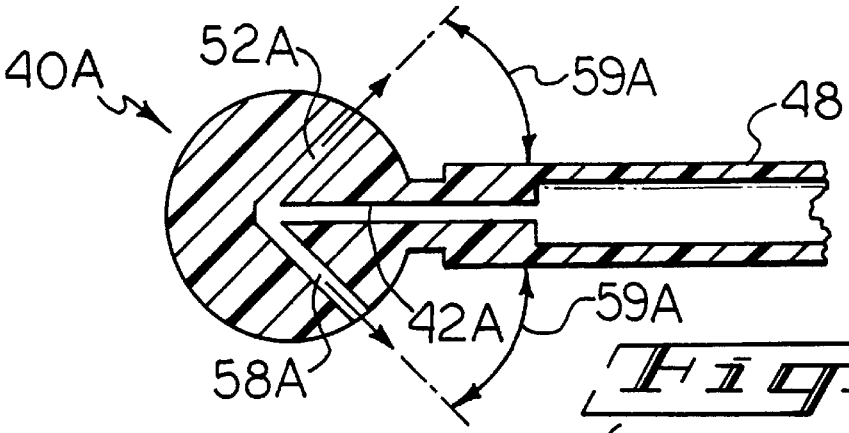
Fig. 6 (PRIOR ART)
FIG. 6 is a greatly enlarged sectional plan view of an air emitting nozzle constructed according to the prior art.

FIG. 6 illustrates a prior art air emitting nozzle or skip ball, generally designated 40A, similar in some respects to skip ball 40. Corresponding parts are identified to by corresponding reference characters followed by the letter A subscript. Ball 40A has an inlet passage 42A in fluid communication with a plurality of forwardly rearwardly diverging outlet passages 52A which are inclined at an acute angle 59A relative to the inlet passage 42A to emit air, in the directions of the arrows 58A to impinge the adjacent wall duct at an inclined angle not normal thereto.

Figure 7:
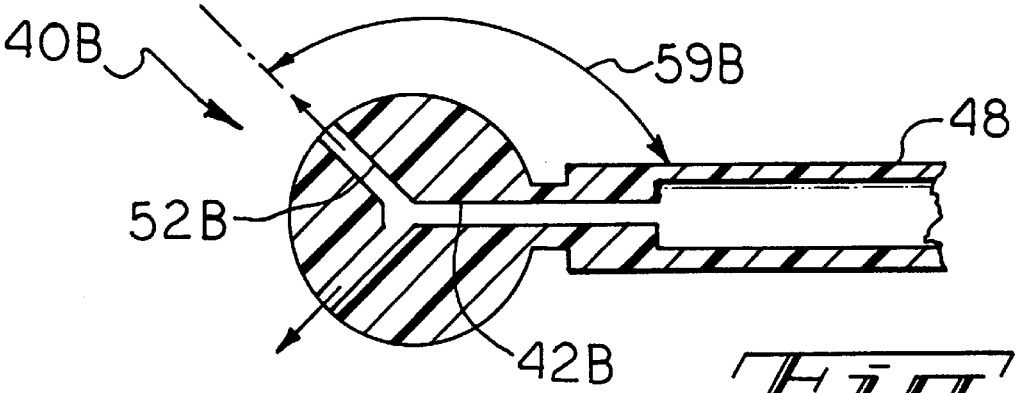
Fig. 7 (PRIOR ART)
FIG. 7 is a view similar to FIG. 6 illustrating a slightly modified prior art air emitting nozzle construction.

FIG. 7 illustrates another slightly modified prior art skip ball or air emitting nozzle, generally designated 40B, having an inlet passage 42B coupled to a plurality of forwardly outwardly diverging outlet passages 54B which are inclined relative to the passage 42B at an obtuse angle 59B.

THE METHOD AND OPERATION

When a duct 12 is to be cleaned, it is preferable, although not absolutely necessary, that a vacuum unit 34 be coupled to the terminal air outlet 28 of the duct 12 to be cleaned.

The cords or cables 70, coupled to the expansible and contractible member 64, are coupled to the swivel 78*a* which is also coupled to the air emitting nozzle or skip ball 40. The skip ball 40 is coupled to the air supply hose 48, that has an upstream end coupled to a source of high pressure, high velocity air. The hose 48 is disposed through an inlet opening 28A provided in the bottom duct wall 16 of the duct 12. If desired, cable 90 may also be coupled to the skip ball 40.

The expansible and contractible member 62 is initially collapsed to a closed position as it is passed through opening 28A into the duct 12. The vacuum unit 34 and air blower 24 are operative when the expansible and contractible member 62 is disposed into the duct 12 so that the expansible and contractible member 62 expands to the open position, such as that illustrated in FIG. 2.

The pressurized air source coupled to air supply hose 48 is then operated to deliver highly pressurized air, represented by the arrow 50, to the nozzle or air emitting unit 40 under high pressure to direct air under high pressure, in the direction of the arrow 54 to impinge at a right angle relative to the planes of the duct walls 14, 16, 18 and 20. The vacuum units 34 and fan 24 are operated to cause substantial draw air to be drawn downstream, in the direction of the arrows 26 and 26A and creating differential pressure on upstream and downstream sides of the sheet 64. The size of the expansible and contractible member 64, in an expanded condition, is such that, relative to the duct 12 a gap, generally designated 80*b* and 83, will exist between opposite sides of a perimetrical portion 82 of the chute and an adjacent duct portion 84 which confronts the portion 82 to provide a passage of relatively small cross section relative to the overall cross section of the duct 12 so that the air, represented by the arrow 86, funnels between the perimeter 82 and the duct wall 84, will have very low pressure but very high velocity. The small gaps 80*b*, 83 in essence, each creates a venturi which has a very low pressure causing a very high velocity of air, represented by the arrow 86, which moves dirt particles 63 dislodged downstream in the direction of the arrow 26.

Figure 3:
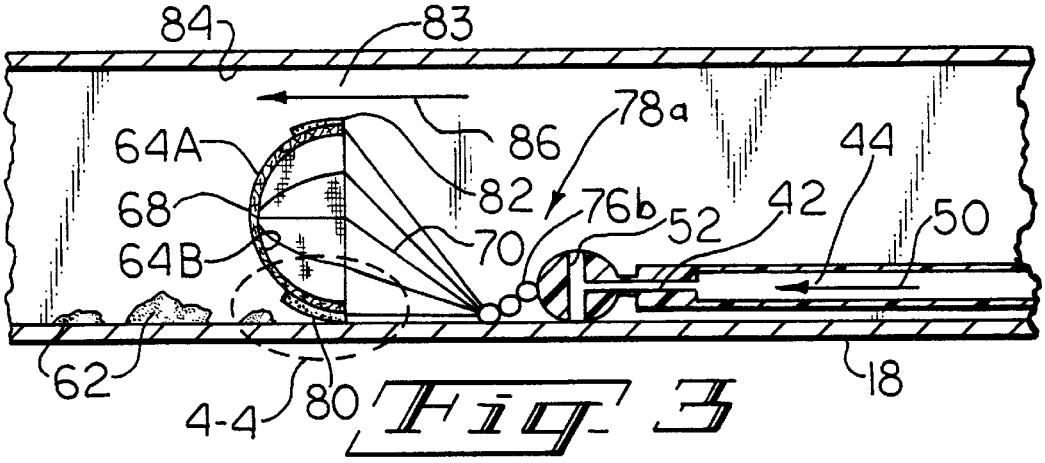
FIG. 3 is a sectional plan view, similar to FIG. 2, illustrating the cleaning apparatus disposed in HVAC duct in an adjusted position.
Figure 4:
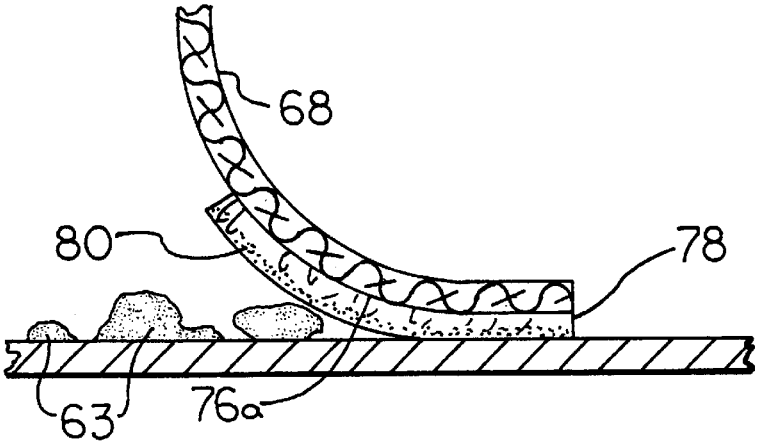
FIG. 4 is a greatly enlarged, sectional plan view more particularly illustrating a perimetrically disposed cleaning strip portion, encircled in the chain line circle 4—4 of FIG. 3.
Figure 5:
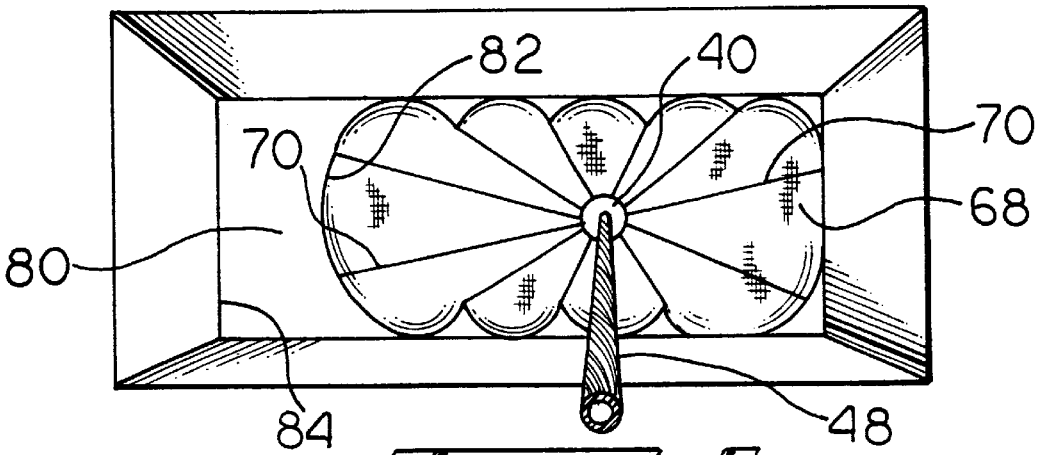
FIG. 5 is a rear isometric view taken from the right side of FIG. 2.

The low pressure created by the high velocity air stream 86 will draw the adjacent confronting parachute portion 82 toward the adjacent duct portion 84 to thus create a similar gap on another perimetrical portion of the parachute 62, as illustrated in FIG. 3. The parachute or draught member 64 and the skip ball 40 will thus be alternatively laterally swung in a to-and-fro path, from one side wall 18 toward the other side wall 20. As the ball and parachute are moved downstream, the parachute and ball will also vertically concurrently swing between the upper and lower duct walls 14 and 16 as they are moved downstream.

The lateral movement of the parachute will force the abrasive layer 78 to abrade the interior duct surface 60 and dislodge particles 63. The dislodged particles 63 become entrained in the high velocity air stream 86 to be moved thereby downstream.

If dislodged particles 63 fall into the upstream side 64B of sheet 64, the air moving downstream in the direction of the arrow A, tending to keep the parachute outwardly bellowed in an open extended condition, will be drawn outwardly therefrom to follow the path represented by the arrow 86 whereby the dirt particles on the upstream side 64B will be removed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for cleaning dirt particles from the interior surface of a hollow heating, ventilating and air conditioning duct coupled to an air moving unit for drawing air therethrough in a downstream path and at a predetermined velocity, said duct having a passage therein with a predetermined cross-sectional area, said apparatus comprising:

an air emitting nozzle;

high pressure air supply conduit means for coupling said nozzle to a source of pressurized air; and means downstream of said nozzle and coupled to said nozzle for drawing said nozzle and said high pressure air supply conduit means through said duct comprising expansible and contractible draught means, responsive to differential pressure forces created by said air moving unit, for expanding outwardly from a closed position to an open position to close a substantial portion of said duct but allowing another substantially smaller portion of said duct between the periphery of said draught means and the interior surface of said duct to remain open to provide a substantially reduced cross-sectional area less than said predetermined cross-sectional area through which air passing downstream in said duct is funneled at a velocity substantially higher than said predetermined velocity to move dirt particles in said duct downstream.

2. The apparatus set forth in claim 1 wherein said nozzle includes an air supply inlet opening and at least one air discharge outlet opening extending normal to said air supply inlet opening.

3. The apparatus set forth in claim 1 wherein said expansible and contractible means comprises a sheet having a perimetrical terminal edge portion;

a plurality of peripherally spaced apart lines coupled between said perimetrical, terminal edge portion and said nozzle within said duct.

4. The apparatus set forth in claim 3 including abrasive means on said perimetrical terminal edge portion for abrading and dislodging dirt which might accumulate on said interior surface.

5. The apparatus set forth in claim 3 wherein said sheet is of such size and shape that, when expanded to said open position, at least a portion of said perimetrical edge is spaced from said interior surface to provide a gap for the passage of air at a velocity substantially greater than said predetermined velocity as said draught means and said nozzle concurrently move downstream.

6. Apparatus for in-situ cleaning the interior surface of a hollow air supply duct coupled to an air moving unit for moving air through said duct in a downstream direction comprising:

air emitting nozzle means, receivable within said duct, for emitting high pressure air toward said interior surface and dislodging any dirt which might accumulate on said interior surface;

a high pressure air supply hose coupled to said air emitting nozzle means and adapted to be coupled to a high pressure air source for supplying high pressure air to said nozzle means; and expansible and contractible draught means coupled to said nozzle means, receivable in said duct and expansible in response to differential pressure forces created by said air moving unit from a closed position to an expanded condition, to move downstream, for drawing said nozzle means and said air supply hose downstream as said draught means is being moved downstream by said differential pressure forces.

7. The apparatus set forth in claim 5 wherein said nozzle means comprises a ball having an air inlet passage for receiving high pressure air from said high pressure hose and an air outlet passage coupled to, and extending perpendicular to, said air inlet passage.

8. The apparatus set forth in claim 6 wherein said expansible and contractible draught means comprises a sheet having a perimetrical edge and a plurality of perimetrically spaced apart draught lines coupled between said perimetrical edge and said ball.

9. The apparatus set forth in claim 7 including abrasive means on said perimetrical edge for wiping and dislodging dirt particles which accumulate on said interior surface.

10. The apparatus set forth in claim 8 wherein said sheet is of such size and shape that when said draught means is in said expanded condition a gap exists between at least a portion of said abrasive means and said interior surface to allow air in said duct to pass therethrough at a high velocity to move particles of dirt in said duct downstream.

11. Apparatus for in-situ cleaning dirt particles from an interior surface of a hollow air duct coupled to an air moving unit for moving air downstream therethrough at a predetermined velocity, said apparatus comprising:

an air emitting nozzle;

high pressure air supply means coupled to said air emitting nozzle; and means in said duct downstream of said nozzle for increasing the velocity of air passing through said duct adjacent said interior surface of said duct to a velocity substantially higher than said predetermined velocity and for concurrently drawing said nozzle downstream comprising expansible and contractible draught means coupled to said air emitting nozzle, having a perimetrical edge and being responsive to differential pressure forces created by said air moving unit to expand outwardly to close a substantial portion, but not all, of said duct for funneling air moving downstream through said duct between said perimetrical edge and a portion of said duct at a velocity substantially higher than said predetermined velocity to draw dirt particles in said duct downstream.

12. The apparatus set forth in claim 10 wherein said expansible and contractible means comprises a sheet having said perimetrical edge, a plurality of perimetrically spaced apart lines coupled to said perimetrical edge and to said air emitting nozzle.

13. The apparatus set forth in claim 11 wherein said lines converge, in an upstream direction toward said nozzle.

14. The apparatus set forth in claim 11 wherein said sheet is of such size and shape that, when expanded, said sheet closes a substantial portion, but not all of said duct.

15. The apparatus set fort in claim 13 wherein said sheet is of such size and shape that, when expanded, a portion of said perimetrical edge is spaced from said interior surface of said wall so that the air passing between said section and said interior surface travels with a substantially increased velocity relative to the velocity of the air passing in said duct upstream and downstream of said sheet.

16. The apparatus set forth in claim 10 wherein said draught means concurrently moves said nozzle and said high pressure air supply means downstream as said draught means is moving downstream.

17. The apparatus set forth in claim 10 wherein said nozzle means comprises a ball having an inlet passage for receiving pressurized air from said air supply means and a discharge passage, normal to said inlet passage for discharging high pressure air toward said interior surface.

18. Apparatus for in-situ cleaning dirt from the inside surface of a hollow air duct having a passage therein of a first predetermined cross-sectional area for passing air in a downstream path of travel, said apparatus comprising:

air emitting means disposable in said duct for emitting pressurized air toward said inside surface of said duct, means, downstream of said air emitting means, for moving said air emitting means in said downstream path of travel comprising expansible and contractible draught means coupled to said air emitting means, receivable in said duct and expansible between a collapsed condition, having a second cross sectional area substantially less than said predetermined cross sectional area, and an expanded condition with a third cross sectional area substantially greater than said second predetermined cross sectional area but less than said first predetermined cross sectional area to close a substantial portion, but not all, of said passage.

19. The apparatus set forth in claim 17 wherein said air emitting means comprises a nozzle having a passage therethrough with an inlet having an axis extending in a first direction and an outlet in fluid communication with said inlet, said outlet having an axis extending a second direction normal to said first direction.

20. Apparatus for in-situ cleaning debris on the inner surface of a hollow air duct having a passage therein for passing air in a downstream path of travel, said apparatus comprising:

air emitting nozzle means, adapted to be coupled to a source of pressurized air and receivable in a hollow air duct for emitting pressurized air toward an inside surface of said hollow air duct;

means for moving said air emitting nozzle means in said downstream path of travel including expansible and contractible sheet means coupled to said air emitting nozzle means, receivable in said duct and expansible, in response to the passage of air in said duct, between a contracted position and an expanded position;

said sheet means having a central portion and a perimetrical sheet portion; and a plurality of perimetrically spaced apart coupling lines coupled between said perimetrical sheet portion and said air emitting nozzle means.

21. The apparatus set forth in claim 19 wherein said lines converge in an upstream direction toward said nozzle means.

22. The apparatus set forth in claim 20 including a layer of abrasive material on a perimetrical sheet portion for abrading said inside surface of said duct to assist in dislodging dirt on said inside surface.

23. Apparatus for the in-situ cleaning the inside surface of a hollow air duct having a passage therein in which a stream of air passes under pressure in a downstream path of travel, said apparatus comprising:

high pressure air emitting means, adapted to be coupled to a source of high pressure air, for emitting high pressure air in a direction normal to the inside surface of said duct; and means for moving said air emitting means in said downstream path of travel including foldable fabric means, responsive to differential pressure created on opposite sides thereof by said stream of air, for expanding between a contracted, folded condition and an unfolded expanded condition in said duct;

said fabric means having a central sheet portion and a perimetrical sheet portion surrounding said central sheet portion; and a plurality of cords coupled between said perimetrical sheet portion and said high pressure air emitting means for drawing said air emitting means downstream.

24. A method of in-situ cleaning dirt from the inside surface of a hollow air duct having a passage therein of a first predetermined cross sectional area and coupled to a vacuum creating unit for passing a stream of air in a downstream path of travel comprising the steps of:

disposing high pressure air emitting nozzle means in said duct; emitting high pressure air toward said inside surface of said duct through said air emitting nozzle means;

moving said high pressure air emitting means in said downstream path of travel by coupling the perimeter of expansible and contractible sheet means to said air emitting nozzle means with a plurality of perimetrically spaced apart lines, and disposing said sheet means in a contracted condition in said duct and expanding said sheet means to an expanded condition in which said sheet means is drawn downstream by said vacuum creating unit to draw said nozzle means downstream.

25. The method set forth in claim 24 including the step of directing said high pressure air by said nozzle means in a direction normal to said inside surface of said duct.

26. The method set forth in claim 24 including the step of swinging said sheet means in said expanded condition in a to-and-fro path transverse to said downstream path as said sheet means moves downstream.

27. The method set forth in claim 26 including the step of swinging said nozzle means in a to-and-fro path as it is moved downstream.

28. The method set forth in claim 24 wherein said method includes the step of alternately swinging said nozzle means in opposite transverse directions in a to-and-fro path as it is moved downstream.

29. The method set forth in claim 28 wherein said step of swinging said nozzle means in said to-and-fro path as it is moved downstream.

30. The method set forth in claim 24 including the step of abrading said inside surface of said duct with a perimetrical portion of said sheet to dislodge dirt thereon.

31. The method set forth in claim 24 in which said step of expanding includes the step of forming high velocity zones of air in said stream of air adjacent the perimeter of said sheet means to concurrently draw dirt particles in said duct downstream to clean said duct as said sheet means is being drawn downstream.

32. A method of in-situ cleaning of dirt which inadvertently accumulates on the inside surface of a hollow air duct that passes a stream of air with a predetermined velocity longitudinally downstream comprising the steps of:

disposing air emitting means in said duct and directing high pressure air toward said inside surface of said duct to dislodge said dirt particles; and moving said air emitting means downstream and concurrently moving said dislodged dirt particles downstream by closing a substantial portion of said duct to form a low pressure, high velocity air zone within said duct through which said stream of air passes with a high velocity substantially higher than said predetermined velocity to entrain the dislodged particles in said stream of air for movement therewith in a downstream path of travel.

33. The method set forth in claim 32 wherein said step of closing is accomplished by disposing expansible and contractible fabric means in said duct, coupling a perimetrical portion of said sheet to said air emitting means for movement therewith, and expanding said sheet means between a collapsed condition and an expanded condition which said sheet closes said substantial portion of said duct and forms said high velocity air zone between said perimetrical portion and an adjacent confronting portion of said duct.

34. The method set forth in claim 33 including the step of wiping said inside surface with abrasive material on said perimetrical portion concurrently with said air emitting means dislodging dirt.

35. Apparatus for in-situ cleaning inadvertently accumulated debris from the inside surface of a heating ventilating air conditioning duct through which a stream of air passes in a downstream path said apparatus comprising:

high pressure air emitting means, moveable downstream within said duct, for emitting high pressure air toward said inside surface to dislodge said accumulated debris as said high pressure air emitting means moves downstream;

means in said duct, downstream of said high pressure air emitting means in said duct, for forwardly drawing said air emitting means through said duct comprising expansible and contractible draught means coupled to said air emitting means, responsible to differential pressure on opposite upstream and downstream sides of said draught means for expanding outwardly between a collapsed condition and an expanded condition in said duct to close a substantial portion, but not all, of said duct and move in a downstream direction;

said draught means comprising a fabric sheet, having a perimetrical portion, and a plurality of perimetrically spaced apart lines, disposed in said duct, coupling said perimetrical portion to said high pressure air emitting means for concurrently moving said high pressure air emitting means downstream as said draught means moves downstream.

36. The apparatus set forth in claim 35 wherein said air emitting means comprises a hose for supplying high pressure air having a downstream terminal end and an upstream end for coupling to a high pressure air source and an air emitting nozzle on said downstream terminal end for emitting a stream of high pressure air normal to said inside surface.

37. A method of in-situ cleaning the inside surface of a heating, ventilating and air conditioning duct, having a passage therein of a first predetermined cross sectional area, for passing a stream of air in a downstream path of travel comprising the steps of:

coupling an expansible and contractible draught means, which is responsive to differential pressure being created on opposite upstream and downstream sides thereof to expand from a contracted condition to an expanded condition, and a high pressure air emitting means for emitting a high pressure airstream;

placing said draught means, in said contracted condition, and said high pressure air emitting means in said duct; and applying differential pressure to opposite upstream and downstream sides of said draught means to expand said draught means to said expanded condition and concurrently move said draught means and said air emitting means downstream.

38. The method set forth in claim 37 wherein said step of expanding said draught means to said expanded condition is accomplished by expanding said draught means in said expanded condition to a position in which said draught means closes a substantial portion, but not all of said duct to form low pressure, high velocity zones through which said stream of air passes with a high velocity to draw dislodged particles downstream.

39. The method set forth in claim 37 including the step of alternately forming low pressure zones between perimetrically spaced portions of said draught means and adjacent confronting portions of said duct causing said draught means to move transversely in opposite to-and-fro directions as it is being moved downstream to wipe said inside surface and abrade and dislodge debris which might inadvertently accumulate on said inside surface.

* * * * *